US009714607B2

(12) United States Patent
Abu Al-Rubb

(10) Patent No.: US 9,714,607 B2
(45) Date of Patent: Jul. 25, 2017

(54) INTERNAL COMBUSTION ENGINE AND A METHOD OF OPERATING AN INTERNAL COMBUSTION ENGINE

(71) Applicant: Khalil Abu Al-Rubb, Doha (QA)

(72) Inventor: Khalil Abu Al-Rubb, Doha (QA)

( * ) Notice: Subject to any disclaimer, the term of this patent is extended or adjusted under 35 U.S.C. 154(b) by 159 days.

(21) Appl. No.: 14/404,308

(22) PCT Filed: May 31, 2013

(86) PCT No.: PCT/GB2013/051452
§ 371 (c)(1),
(2) Date: Nov. 26, 2014

(87) PCT Pub. No.: WO2013/179054
PCT Pub. Date: Dec. 5, 2013

(65) Prior Publication Data

US 2015/0107547 A1 Apr. 23, 2015

(30) Foreign Application Priority Data

May 31, 2012 (GB) ..... 1209704.4

(51) Int. Cl.
*F02B 47/02* (2006.01)
*F02B 75/00* (2006.01)
(Continued)

(52) U.S. Cl.
CPC ..... *F02B 75/002* (2013.01); *F01B 11/001* (2013.01); *F01B 11/08* (2013.01);
(Continued)

(58) Field of Classification Search
CPC ..... F02M 2700/4321; F02M 25/022; F02B 47/02; F02B 3/06
(Continued)

(56) References Cited

U.S. PATENT DOCUMENTS 1,590,204 A 6/1926 Powell
1,620,565 A 3/1927 McKeown
(Continued)

FOREIGN PATENT DOCUMENTS

CN 1851236 10/2006
DE 316923 12/1919
(Continued)

OTHER PUBLICATIONS

International Search Report, Application No. PCT/GB2013/051452, dated Jan. 17, 2014.
(Continued)

*Primary Examiner* — Hung Q Nguyen
*Assistant Examiner* — Charles Brauch
(74) *Attorney, Agent, or Firm* — Barnes & Thornburg LLP

(57) ABSTRACT

An internal combustion engine comprises an engine block defining a cylinder having a longitudinal axis A. A piston is arranged slidably within the cylinder and an impeller is arranged at one end of the cylinder. The impeller is rotatably mounted on a shaft, which extends out of the cylinder and which is driven in rotation by rotation of the impeller. The engine further comprises an anti-rotation formation to prevent the piston rotating about a longitudinal axis of the cylinder and a swirl-inducing vane arranged on the face of the piston which faces the end of the cylinder at which the impeller is arranged. Combustion gas generated by combustion of a fuel in the cylinder between the piston and the impeller is caused to swirl by reaction with the swirl-inducing vane and the swirling combustion gases, in turn, cause the impeller to rotate.

19 Claims, 10 Drawing Sheets

Figure 1:
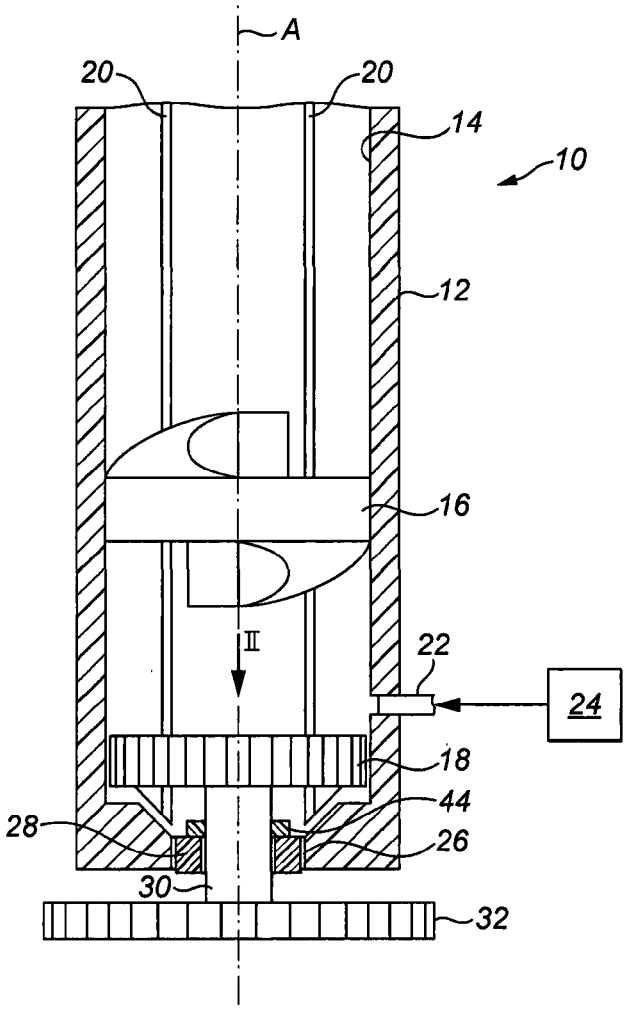

(51) Int. Cl.

| | |
|---|---|
| ***F02B 71/04*** | (2006.01) |
| ***F02B 63/04*** | (2006.01) |
| ***F01B 11/08*** | (2006.01) |
| ***F01B 11/00*** | (2006.01) |
| *F02M 25/022* | (2006.01) |
| *F02M 1/00* | (2006.01) |
| *F02B 3/06* | (2006.01) |
| *F02B 71/02* | (2006.01) |

(52) U.S. Cl.
CPC ..... *F02B 63/04* (2013.01); *F02B 71/04* (2013.01); *F02B 3/06* (2013.01); *F02B 47/02* (2013.01); *F02B 71/02* (2013.01); *F02M 1/00* (2013.01); *F02M 25/022* (2013.01); *F02M 25/0228* (2013.01); *F02M 2700/4321* (2013.01)

(58) Field of Classification Search
USPC ..... 123/25 A
See application file for complete search history.

(56) References Cited

U.S. PATENT DOCUMENTS

| | | | | |
|---|---|---|---|---|
| 1,807,087 | A | 5/1931 | Finke | |
| 2,410,565 | A | 11/1946 | Brockhurst | |
| 2,439,867 | A | 4/1948 | Schaeffer | |
| D132,990 | S | 11/1978 | Schlosser | |
| 4,205,528 | A | 6/1980 | Grow | |
| 4,357,915 | A | 11/1982 | Monsour | |
| 4,869,212 | A | 9/1989 | Sverdlin | |
| 4,919,104 | A | 4/1990 | Hensel et al. | |
| 5,551,233 | A | 9/1996 | Tomoiu | |
| 6,349,682 | B1 * | 2/2002 | Alexius et al. | F02M 49/02 123/46 A |
| 7,905,210 | B2 | 3/2011 | Eto et al. | |
| 2001/0029922 | A1 | 10/2001 | Dow | |
| 2003/0108830 | A1 | 6/2003 | Jacobsen | |
| 2005/0115243 | A1 | 6/2005 | Adle | |

FOREIGN PATENT DOCUMENTS

| | | |
|---|---|---|
| DE | 2540250 | 3/1977 |
| DE | 2619932 | 11/1977 |
| DE | 3000276 | 7/1981 |
| DE | 3001094 | 7/1981 |
| DE | 3831451 | 4/1990 |
| DE | 4210313 | 10/1993 |
| DE | 10124056 | 11/2002 |
| EP | 2434218 | 3/2012 |
| GB | 280283 | 11/1927 |
| GB | 377168 | 7/1932 |
| GB | 1138633 | 1/1969 |
| GB | 2183726 | 6/1987 |
| JP | 08178010 | 7/1996 |
| JP | 2002030937 | 1/2002 |
| JP | 2006207635 | 8/2006 |
| WO | 01/59277 | 8/2001 |
| WO | 2007086729 | 8/2007 |
| WO | 2009/045521 | 4/2009 |

OTHER PUBLICATIONS

International Preliminary Report on Patentability, Application No. PCT/GB2013/051452, dated Nov. 13, 2014.
United Kingdom Search Report, Application No. GB1209704.4 relating to claims 13 to 16, dated Dec. 5, 2012.
United Kingdom Search Report, Application No. GB1209704.4 relating to claim 17, dated Dec. 5, 2012.
United Kingdom Search Report, Application No. GB1209704.4 relating to claim 18, dated Dec. 5, 2012.
Chinese Search Report, Application No. 2013800402234.
United Kingdom Search Report, Application No. GB1209704.4 relating to claims 1 to 7, dated Sep. 19, 2012.
United Kingdom Search Report, Application No. GB1209704.4 relating to claims 8 to 12, dated Dec. 5, 2012.

* cited by examiner

INTERNAL COMBUSTION ENGINE AND A METHOD OF OPERATING AN INTERNAL COMBUSTION ENGINE

CROSS REFERENCE TO RELATED APPLICATIONS

This application is a U.S. nationalization under 35 U.S.C. §371 of International Application No. PCT/GB2013/051452, filed May 31, 2013, which claims priority to United Kingdom Application No. 1209704.4, filed May 31, 2012.

The present invention relates to an internal combustion engine.

Various arrangements of internal combustion engine are known including the auto-cycle or four-stroke engine, the two-stroke engine and the Wankel rotary engine being amongst the most common. Other engine formats are known including those employing a five and six engine cycles and gas turbines. Two and four-stroke internal combustion engines employ pistons moving reciprocally in a cylinder. Combustion in the cylinder drives the piston reciprocally back and fourth within the cylinder and the power is taken from the reciprocal motion of the piston by means of a rod connected to the piston which drives the crank shaft to generate a rotary power output. The Wankel engine does not employ a reciprocating piston. Instead it uses an eccentric shaft rotating in a obround chamber to effect intake, compression, ignition and exhaust. A gas turbine is also a rotary machine comprising a compressor, combustion chamber and a turbine. Internal combustion engines which employ the slidably reciprocal piston and chamber and which convert that reciprocating motion into a rotary output using a connecting rod suffer from the issue that some of the energy of combustion is lost due to the friction between the piston cylinder and the connecting rod and the crank shaft.

It is an object of the invention to provide an improved internal combustion engine.

Turning to a first aspect of the invention, there is provided an internal combustion engine comprising an engine block defining a cylinder having a longitudinal axis, a piston arranged slidably within the cylinder and an impeller arranged at one end of the cylinder, the impeller being rotatably mounted on a shaft, which shaft extends out of the cylinder and which is driven in rotation by rotation of the impeller, the engine further comprising an anti-rotation formation to prevent the piston rotating about a longitudinal axis of the cylinder and a swirl-inducing vane arranged on the face of the piston which faces the end of the cylinder at which the impeller is arranged, whereby combustion gas generated by combustion of a fuel in the cylinder between the piston and the impeller is caused to swirl by reaction with the swirl-inducing vane and the swirling combustion gases, in turn, cause the impeller to rotate.

In that way, the energy of combustion is converted into rotation of an output shaft without the requirement for mechanical inter-connection between the piston and the shaft.

The piston preferably includes a plurality of swirl-inducing vanes on the face which faces the end of the cylinder at which the impeller is arranged.

In a preferred arrangement, an impeller is arranged at each end of the cylinder and a piston is provided with a swirl-inducing vane or vanes on opposite faces thereof facing the impellers.

Where impellers are provided at each end of the cylinder, the fuel-injector is arranged to inject the fuel into the cylinder at both ends thereof.

In one arrangement, an ignition mechanism, for example the spark plug, is arranged at or adjacent the end of the cylinder in which the impeller is located. Where impellers are provided at both ends of the piston, ignition mechanisms are provided at both ends. Alternatively, the fuel may be ignited by compression effected by the movement of the piston in the cylinder in similar fashion to a diesel engine.

According to a second aspect of the invention there is provided an internal combustion engine comprising an engine block which defines an elongate cylinder having a longitudinal axis, a piston arranged in the cylinder so as to be slidable longitudally back and forth in the cylinder, the piston not being connected mechanically to an output drive shaft of the engine, whereby combustion of fuel on one side of the piston causes movement of the piston along the cylinder to displace gas in the cylinder on the other side of the piston, so that combustion gases produced by said combustion drive an impeller whereby at least some of the motive power of the engine is generated by the combustion gases acting on the impeller.

In that way, most of the power is generated by the escaping exhaust gasses driven by the reciprocation of the piston.

In an internal combustion engine according to the second aspect, the piston may have a swirl-inducing vane on one face thereof and an internal impeller may be arranged at the end of the cylinder facing the piston with a vane so that combustion gas generated by combustion of a fuel in the cylinder is caused to swirl by reaction with the swirl-inducing vane and the swirling combustion gases, in turn, cause the internal impeller to rotate.

Where internal and external impellers are driven by the combustion gases, the external impeller preferably drives an external impeller drive shaft. In that case, the external impeller drive shaft may be drivingly connected to a main output drive shaft of the engine. Alternatively, the external impeller drive shaft may an electrical generator to generate electrical power which can, in turn, be used to provide motive power, for example by powering an electric motor.

Where the engine of the second aspect is provided with an internal impeller, the internal impeller drive shaft may drive a main output drive shaft of the engine or may power an electrical generator, allowing generation of electricity which, in turn, can be used to provide motive power.

According to a third aspect of the invention there is provided an internal combustion engine comprising a plurality of cylinder housings, each defining therewithin an elongate cylinder, each cylinder having a longitudinal axis, each cylinder having a drive shaft which extends out of the cylinder housing, axially of the cylinder, each drive shaft having a toothed gear wheel thereon, the engine further comprising a main gear which drives an output drive shaft, the gear wheels of the drive shafts being arranged to mesh with the main gear whereby rotation of the drive shaft of a cylinder rotates the main gear which, in turn, rotates the output drive shaft, the cylinders being arranged around the periphery of the main gear.

Because the cylinders each directly output a rotary power output via the drive shaft extending therefrom, rather than a reciprocating power output which must be converted by means of connecting rod and crank shaft, it is convenient to provide a gear on each of the cylinder drive shafts which can be arranged around a main gear to generate a main output drive. For the sake of compactness, the cylinders are arranged around the periphery of the main gear.

For a particularly compact arrangement, the gear may comprise an internally toothed ring and the cylinders may be arranged around the periphery of the main gear internally of the main gear.

In an alternative arrangement, the main gear wheel has external teeth and the cylinders are arranged around the outer periphery of the main gear wheel.

The output drive shaft from the main gear may drive the input shaft of a vehicle transmission or it may drive an electrical generator to effect generation of electrical power, the electrical power being used to provide motive force.

According to a fourth aspect of the invention, there is provided a method of operating an internal combustion engine, the engine comprising an engine block, a cylinder formed in the engine block and a piston arranged slidably reciprocal in the cylinder, a gas inlet valve arranged adjacent one end of the cylinder, to allow gas to pass into the cylinder, outside of the cylinder and a gas output valve adjacent said one end of the cylinder to allow gas in the cylinder to pass to a gas outlet path, a gas inlet valve arranged adjacent to the opposite end of the cylinder and a gas outlet valve arranged adjacent the opposite end of the cylinder, the method comprising the steps of;

i) closing the gas outlet valves, ii) introducing gas into the cylinder via the gas inlet valve at one end of the cylinder so as to force the piston away from said one end towards said opposite end and to compress gas in said opposite end, iii) maintaining a gas pressure in the gas outlet path at a level below ambient pressure, iv) introducing fuel into the cylinder at said opposite end, v) igniting the introduced fuel so as to cause the piston to move along the cylinder away from said opposite ends towards said one end, thereby further compressing gas in the cylinder at said one end, vi) opening the gas outlet valve at said opposite end to allow combustion gas to pass to the gas output path, vii) introducing gas into the cylinder via the gas inlet valve at said opposite end, so as to force the piston away from said opposite end and to compress gas at said one end, viii) evacuating the combustion gas from the gas outlet path and establishing a gas pressure in the gas outlet path at a level below ambient pressure, ix) introducing fuel into the cylinder at said one end, x) igniting the introduced fuel so as to cause the piston to move along the cylinder away from said one end towards said opposite end, thereby further compressing gas at said opposite end, xi) opening the gas outlet path at said one end to allow combustion gas to exhaust from the cylinder to the gas outlet path, xii) repeating steps i) to xi).

According to a fifth aspect of the invention, there is provided a water/fuel emulsion fuelled internal combustion engine comprising an engine block defining a combustion chamber, a fuel inlet port leading into the chamber, a combustion gas outlet port leading from the chamber, an impeller in the chamber, the impeller being rotatably mounted on a shaft, which shaft extends out of the combustion chamber and which is driven in rotation by rotation of the impeller, a swirl-inducing formation being formed on an inside wall of the combustion chamber spaced from and generally opposite the impeller, an ignition device arranged adjacent the swirl-inducting formation, and an ignition mechanism adjacent the swirl-inducing formation whereby a water/fuel emulsion and air are introduced into the chamber, the ignition mechanism ignites the emulsion/air mixture and the combustion gases are caused to swirl by the swirl-inducing formation so as to impart rotation to the impeller.

Figure 2:
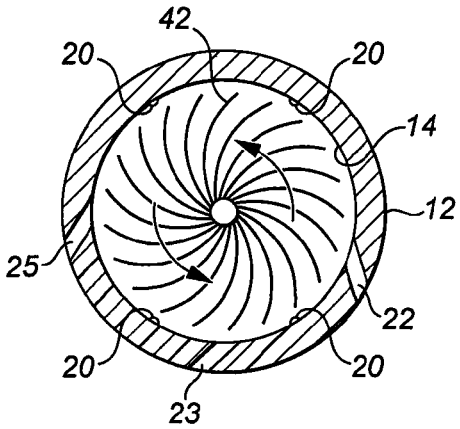
Figure 3A:
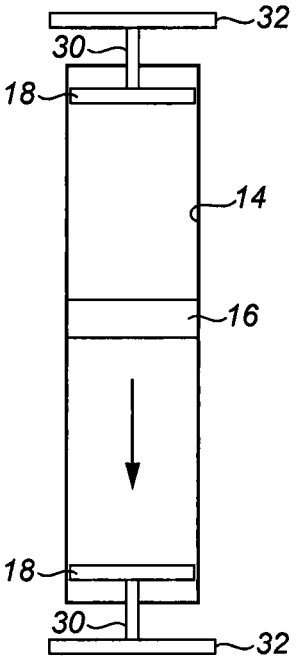
Figure 3B:
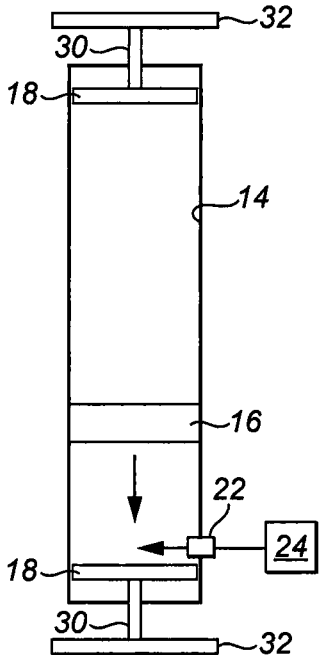
Figure 3C:
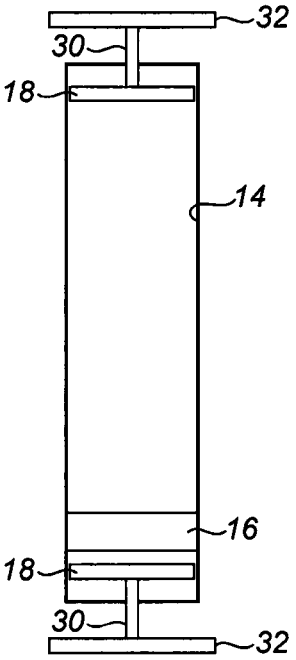
Figure 3D:
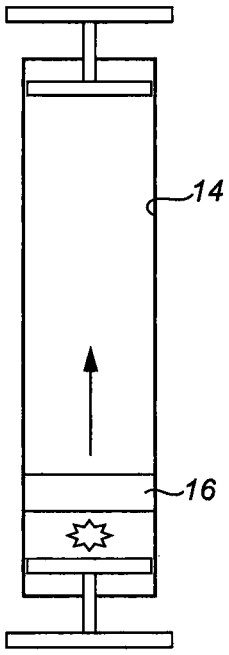
Figure 3E:
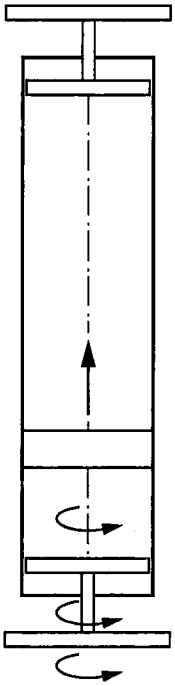
Figure 3F:
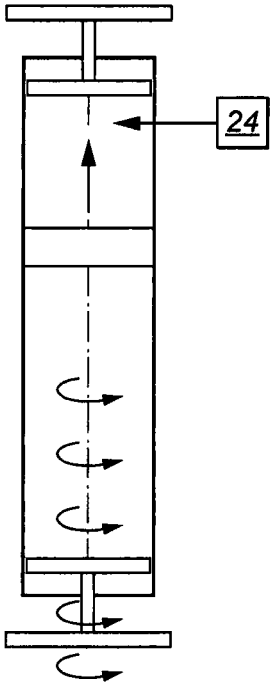
Figure 3G:
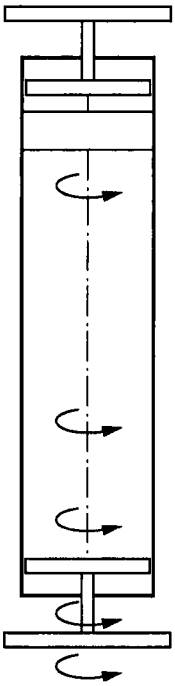
Figure 3H:
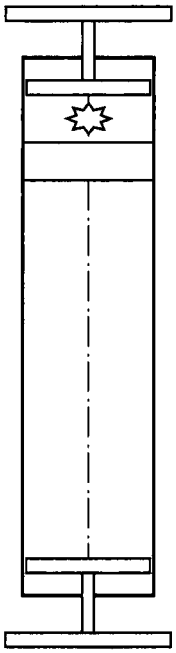
Figure 3I:
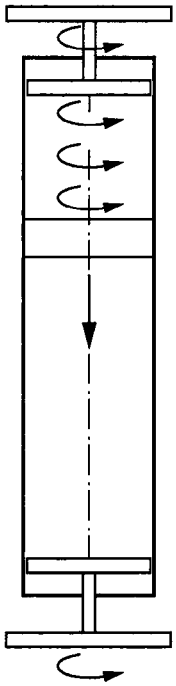
Figure 4:
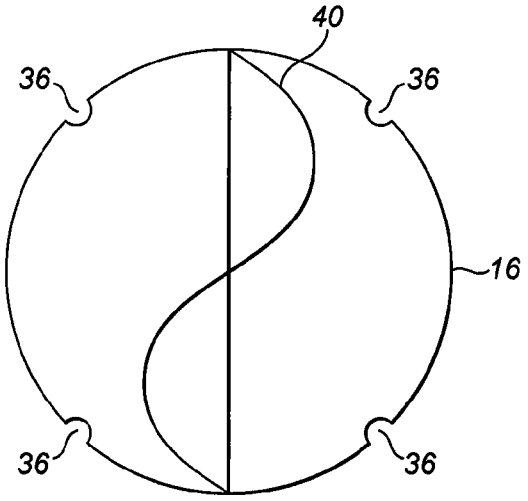
Figure 5:
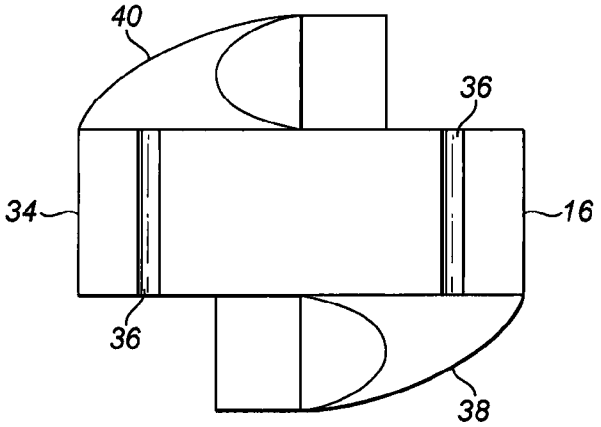
Figure 6:
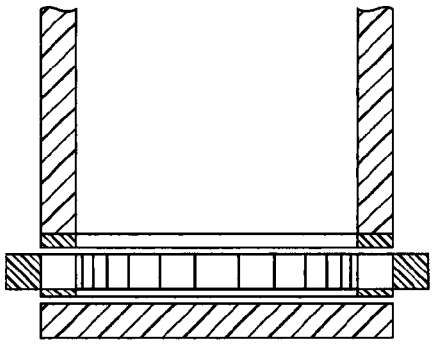
Figure 7A:
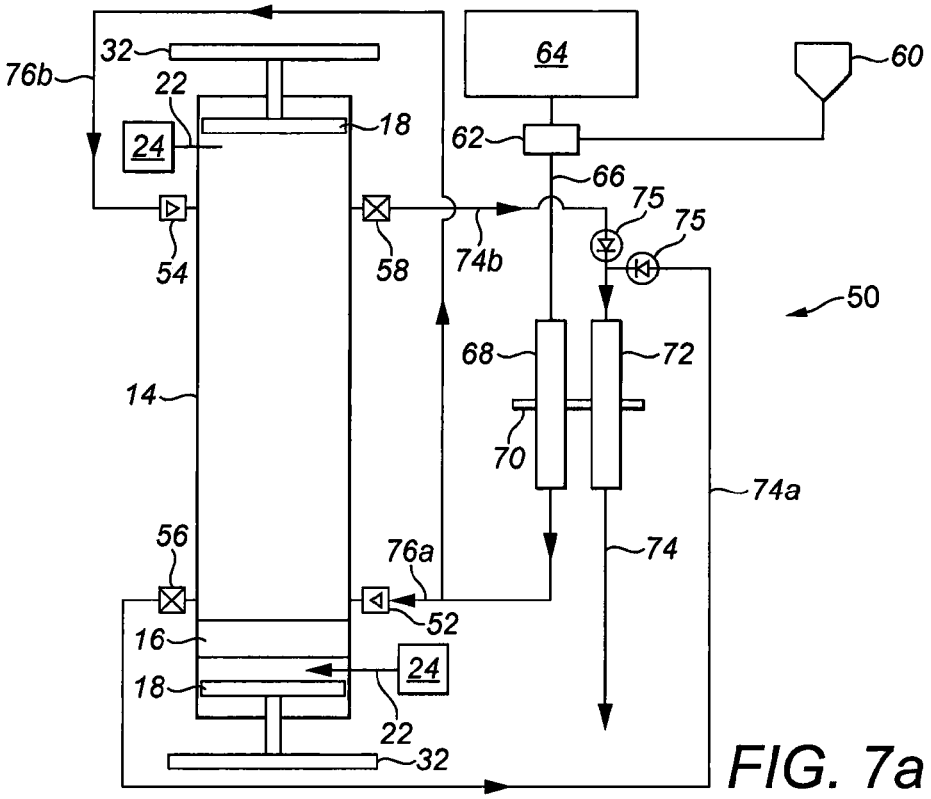
Figure 7B:
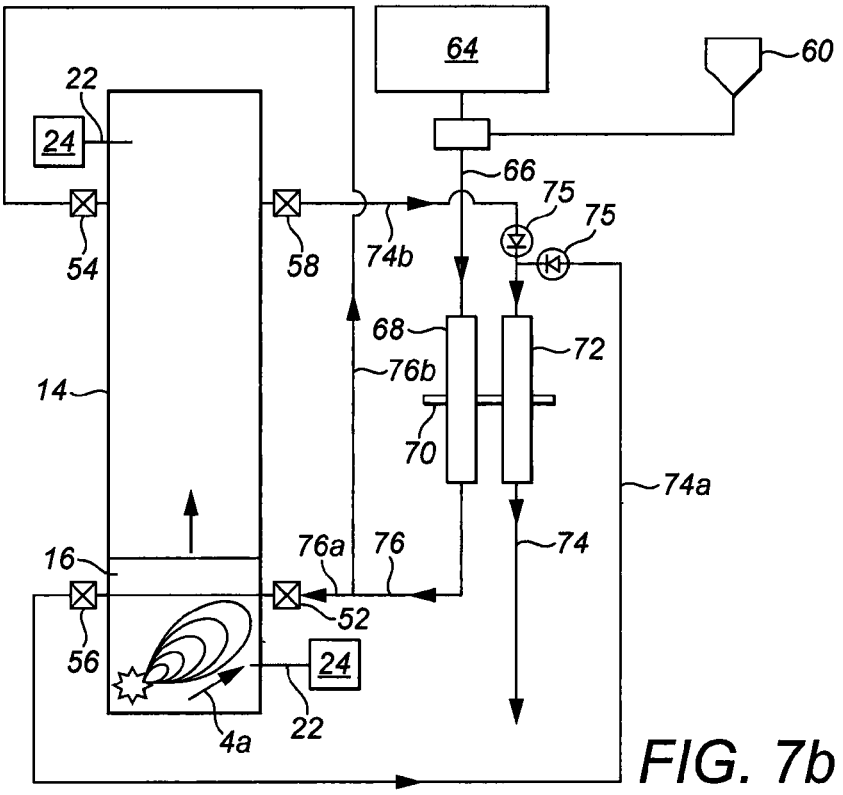
Figure 7C:
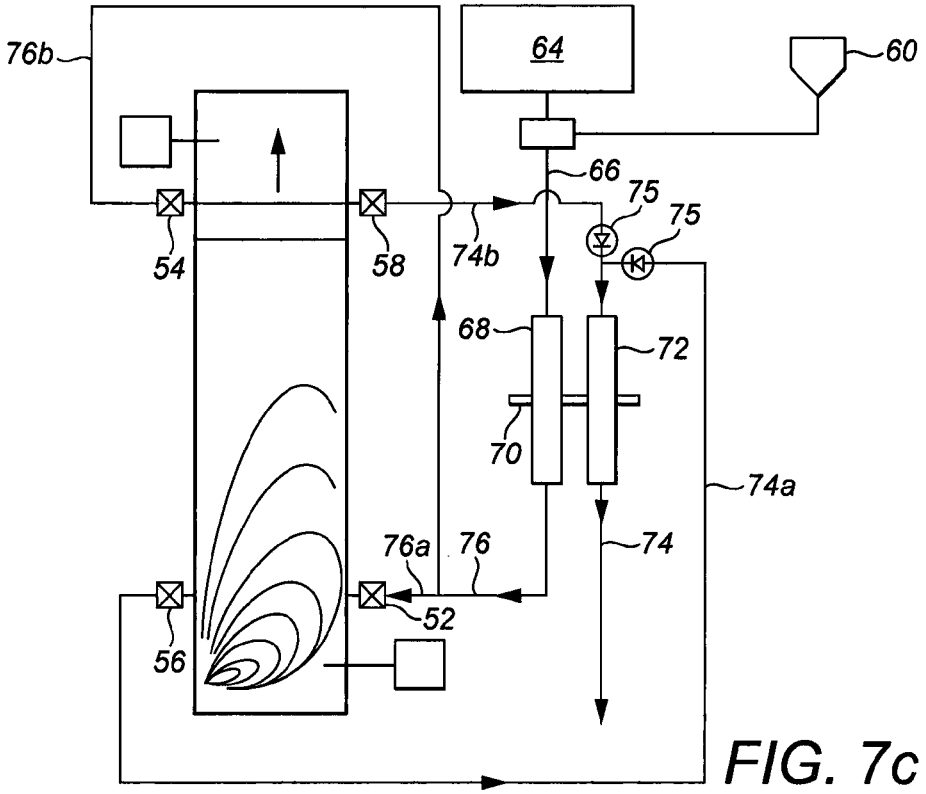
Figure 7D:
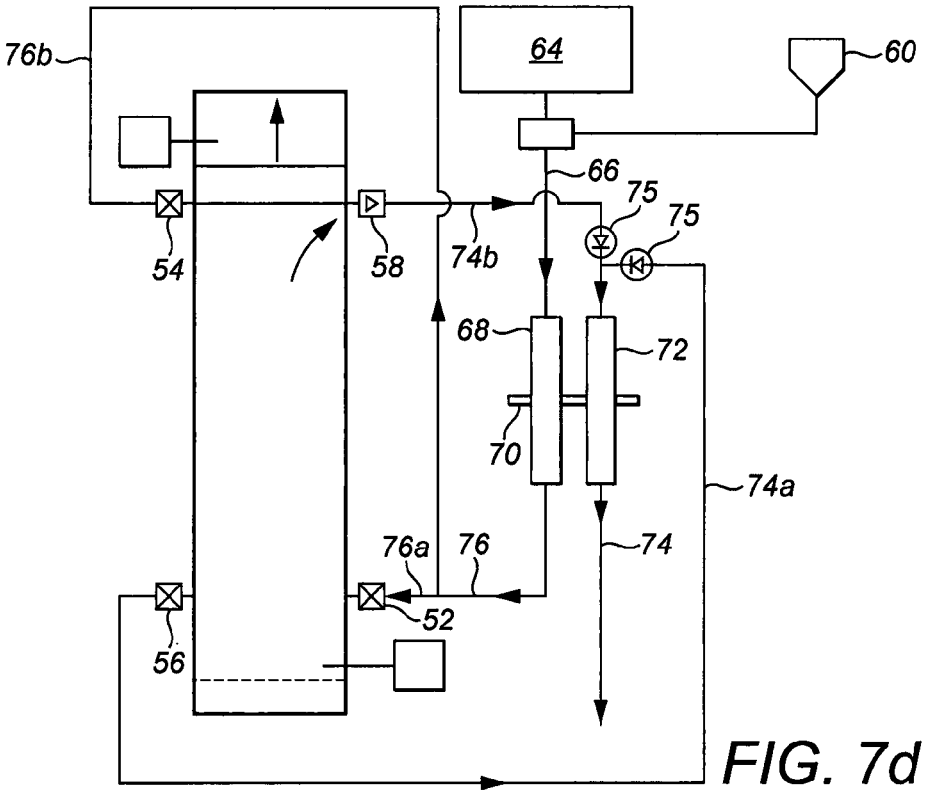
Figure 7E:
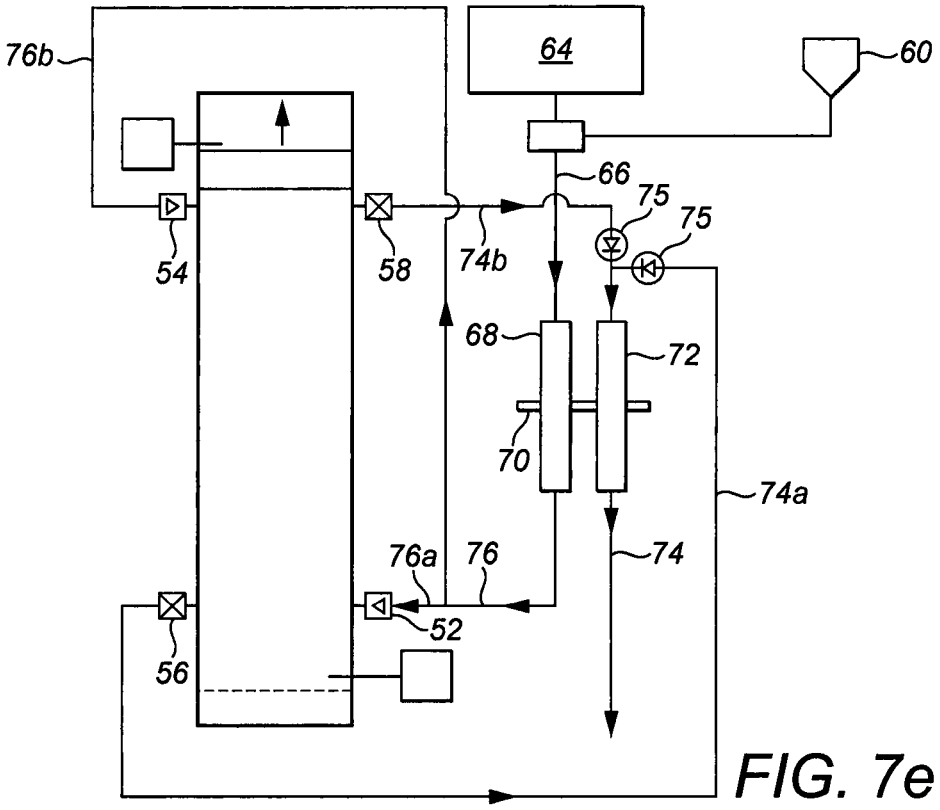
Figure 8:
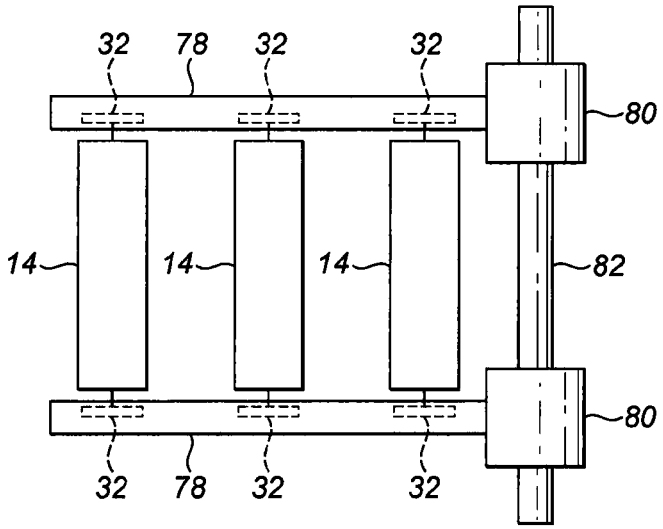
Figure 9:
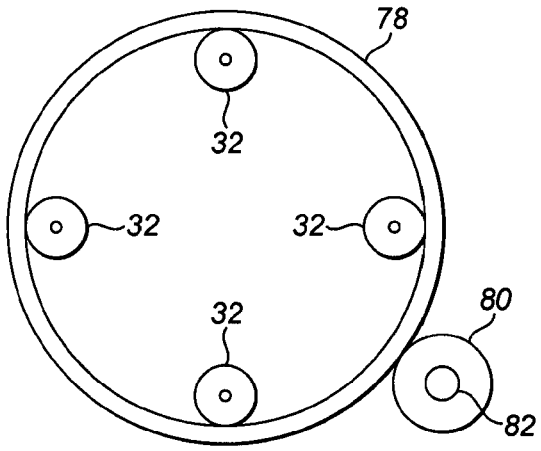
Figure 10:
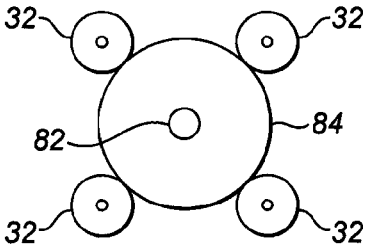
Figure 11:
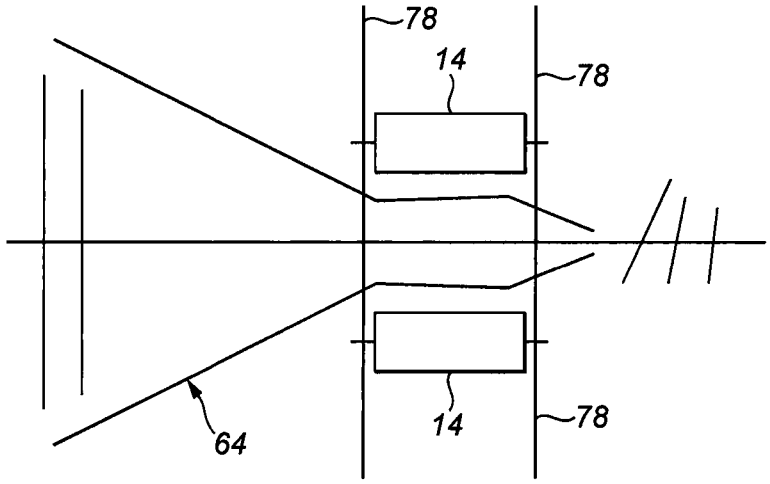
Figure 12:
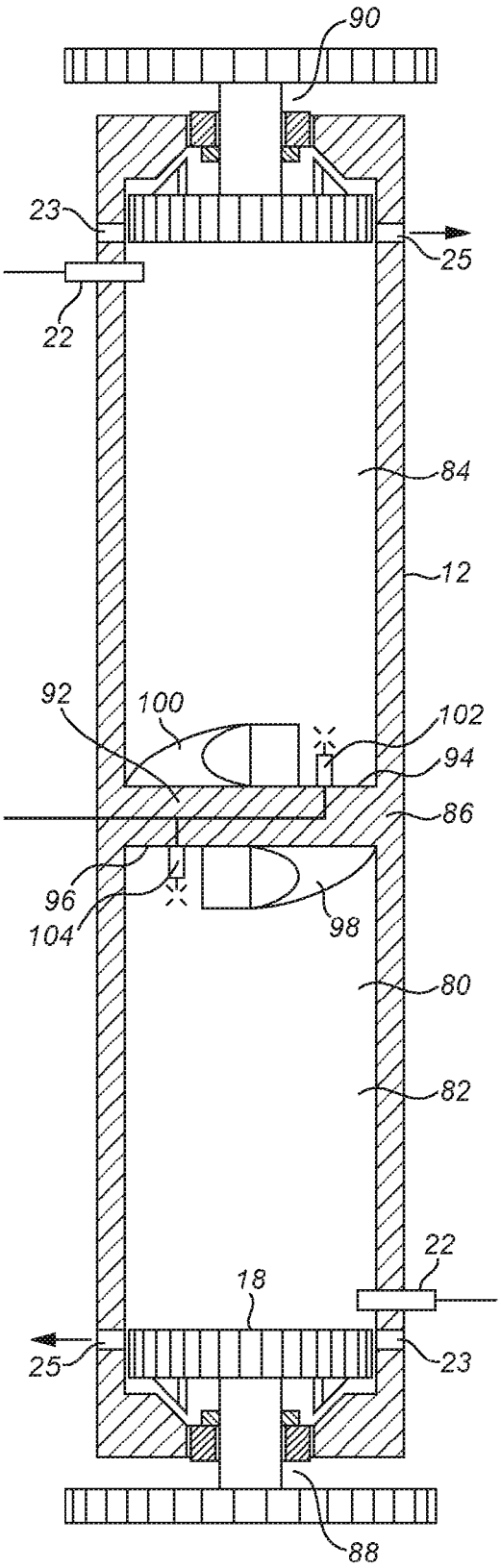

Examples of combustion engines embodying the above aspects of the invention will be described in detail below by way of example and with reference to the accompanying drawings, in which:

FIG. 1 is a schematic sectional view of part of a cylinder of an internal combustion engine in accordance with the invention, FIG. 2 is a schematic plan view of the cylinder of FIG. 1 with the piston omitted to show the impeller detail, FIGS. 3*a* to 3*i* are schematic views of the cylinder of FIGS. 1 and 2 showing the cycle of operation of that cylinder, FIG. 4 is a detailed plan view of a piston employed in the cylinder in FIG. 1, FIG. 5 is a side elevation of the piston of FIG. 4, FIG. 6 is a schematic section of part of a cylinder similar to FIG. 1 with an alternative impeller arrangement, FIGS. 7*a* to 7*e* are schematic views of an engine in accordance with the first, second and fourth aspects of the invention, FIG. 8 is a schematic elevation of an internal combustion engine in accordance with the third aspect of the invention, FIG. 9 is an end elevation of the engine of FIG. 8, FIG. 10 is an end elevation of an alternative arrangement of engine in accordance with the third aspect of the invention, FIG. 11 is a schematic side elevation of a further engine in accordance with the third aspect of the invention as shown driving a turbine, and FIG. 12 is a schematic section of a further engine in accordance with the fifth aspect of the invention.

In FIG. 1, an internal combustion engine arrangement 10 comprises an engine block 12 defining a cylinder 14. A piston 16 is arranged slidably within the cylinder 14 and an impeller assembly 18 is arranged at one end of the cylinder 14.

Although the engine block 12 is shown as having relatively thin walls for clarity, the cylinder 14 is formed in the engine block in a known fashion and is likely to have thicker walls than illustrated in FIG. 1.

The cylinder 14 is elongate and has an axis A. A cylinder 14 is circular in across-section taken perpendicular to the longitudinal axis. Four beads 20 which project inwardly from the inner wall of the cylinder 14 extend parallel to the longitudinal axis A of the cylinder 14. The beads 20 are regularly angularly spaced relative to each other at 90 degree angles, as can be seen in FIG. 2. A fuel injector port 22 is arranged in the side wall of the cylinder 14 which receives fuel from a fuel reservoir 24 and is arranged to inject fuel into the cylinder 14. An air inlet port 23 is formed through the wall of the cylinder 14. An exhaust outlet port 25 is also formed through the wall of the cylinder 14. The inlet port 23, outlet port 25 and fuel injector port 22 are all preferably arranged so that fluid entering or exiting the cylinder through them must travel in a non-radial direction. This enhances the swirling effect in the cylinder. The end wall of the cylinder 14, at the lower end in FIG. 1, defines an aperture 26 arranged co-axially with the cylinder 14. The aperture 26 receives a bearing 28 which, in turn, bears a shaft 30 driven by the impeller 18. A toothed gear wheel 32 is arranged on the end of the shaft 30 which projects out of the cylinder 14.

In an alternative arrangement, fuel is injected centrally via a fuel injector port running along the axis of the shaft 30.

The piston 16 is best described with reference to FIGS. 1, 4 and 5. A piston 16 comprises a substantially cylindrical body 34 which is dimensioned to be a close sliding fit in the cylinder 14. Four grooves 36 are formed in the outer periphery of the circular cylindrical body 34 extending parallel with the axis of the circular cylindrical body 34 and regularly angularly spaced around the periphery at 90 degrees relative to each other. The grooves 36 are dimensioned to be slightly larger than the beads 20 so that when it is arranged in the cylinder, the piston 16 runs along the beads 20 and the beads 20 prevent the piston 16 from rotating about the axis A. A swirl-inducing vane formation 38 protrudes from one circular face of the circular cylindrical body 34 of the piston 16 and a second swirl-inducing vane formation 40 extends from the opposition circular face of the circular cylindrical body 34. The swirl-inducing vane formations 38, 40 have the shape of a yin and yang symbol when viewed in plan and when viewed in side elevation, have a curved form with a scooped out portion (see FIGS. 4 and 5).

The impeller assembly 18 comprises a series of impeller blades 42 mounted to the shaft 30 whereby rotation of the impeller blades 42 causes the shaft 30 to rotate. A mechanical pressure seal bearing 44 is arranged between the bearing 28 and the shaft 30 to prevent gas from escaping from the cylinder via impeller arrangement 18 and aperture 26.

The operation of the internal combustion engine described in FIGS. 1 to 5 is illustrated schematically in FIGS. 3*a* to 3*i*. In FIGS. 3*a* to 3*i*, most of the details of the engine have been omitted for clarity. The engine cycle described in FIGS. 3*a* to 3*i* relates to the cycle when the engine is running and the start-up cycle of the engine will be described later.

In FIG. 3*a*, the piston 16 is moving downwardly from a mid point of the cylinder 14 towards the lower end of the cylinder 14 causing the gas beneath the piston 16 to be compressed. In FIG. 3*b*, as the piston 16 continues it downward movement, fuel is injected via injector port 22 from the fuel reservoir 24 into the cylinder 14 in the region of the cylinder beneath the piston 16. In FIG. 3*c*, the piston 16 has moved downwardly to its lower extent. At that point, the fuel injected by injector 22 is ignited. As mentioned above, that ignition can occur either automatically due to the elevation in temperature of the gas compressed by the downward movement of the piston 16, as in a conventional diesel engine, or it can be ignited by means of a sparking arrangement as in conventional petrol driven four stroke engines. On ignition, as illustrated in FIG. 3*d*, the piston 16 begins to be forced upwardly towards the opposite end of the cylinder 14. The piston is prevented from rotating about the axis A by means of the beads 20 running in the grooves 36. The swirl-inducing vane formation 38 reacts against the rapidly extending combustion gases to induce a swirling motion in those gases about the axis A, as shown in FIG. 3*e*. The swirling combustion gases act upon the impeller blades 42, as shown in FIG. 2 and FIG. 3*e* that, in turn, causes the impeller 18 to rotate, together with the shaft 30. The rotation of the shaft 30 drives the geared wheel 32 in rotation. As the piston 16 continues to move upwardly in FIG. 3*f*, the combustion gases are still swirling about axis A and fuel is then injected above the piston via the fuel injector port at the opposite end of the cylinder 14. When the piston 16 reaches the top extent of its travel as shown in FIG. 3*g*, the swirling energy in the combustion gases has largely been transmitted to the impeller which continues to rotate. At that point, as shown in FIG. 3*h*, the fuel/air mixture above the piston ignites and the swirl-inducing vane formation 40 on the upper face of the piston 16 in FIG. 3*i* produces swirl in the combustion gases which, in turn, turns the impeller 18 at the upper end of the cylinder 14. The piston 16 is driven downwardly back towards the lower end of the cylinder and the cycle repeats. The evacuation of combustion gases from the cylinder 14 will be described in more detail below.

In FIGS. 7*a* to 7*e*, the combustion cycle in an engine having a cylinder as described above, is illustrated. In FIG. 7*a* an internal combustion engine 50 comprises an engine block defining a cylinder 14 as described above. The cylinder 14 has an impeller arrangement 18 at each end thereof as described in FIG. 1. The cylinder 14 further includes a gas inlet valve 52 at one end thereof, a gas inlet valve 54 at the other end thereof, a gas outlet valve 56 at said one end thereof and a gas outlet valve 58 at said other end thereof. A starter motor 60 is connected by means of a drive pulley 62 to an air compressor 64. The air compressor 64 has an outlet flow path 66. A first external impeller 68 is arranged in the outlet flow path 66 so that air driven by the compressor 64 via flow path 66 drives the impeller 68 in rotation. First external impeller 68 is mounted on a shaft 70 which, in turn, mounts a second external impeller 72. When the first external impeller 68 is driven by gas flowing in the flow path 66, the second external impeller 72 is driven by the common drive shaft 70. The second external impeller 72 is in an exhaust gas outlet flow path 74. A gas inlet flow path 76 extends from the first external impeller 68 and splits into gas inlet flow sub-paths 76*a*, 76*b* in communication with the gas inlet valves 52, 54. Gas outlet flow sub-paths 74*a*, 74*b* extend from gas outlet valves 56, 58 and merge into gas outlet flow path 74. A non-return valve 75 is formed in each gas outlet flow sub-path 74*a, b* upstream of the second external impeller. The volume of each gas inlet flow sub-path 76*a*, 76*b* is chosen to be very similar or identical to the volume of stroke of the piston. The volume of the outlet flow paths 74 is designed to be substantially equal to the volume of exhausted combustion gas.

To operate the engine from start, the starter motor 60 turns the air compressor 64 by means of the drive pulley 62. Air from the air compressor 64 passes along the compressor outflow path 66 to drive impeller 68. Air that drives impeller 68 passes via the gas inlet valve 52, which is open, into the interior of the cylinder 14 above the piston 16 so as to effect compression of the air beneath the piston 16 in FIG. 7*a*. Optionally, air can also pass via the gas inlet valve 54. Gas outlet valves 56, 58 are closed. The rotation of the first external impeller 68 causes the second external impeller 72 to be rotated and the action of the impeller 72 in the exhaust gas flow path 74 causes that flow path to have a pressure below ambient atmospheric pressure.

Fuel is introduced into the cylinder 14 via fuel injector 22 from fuel reservoir 24. In the arrangement shown, combustion of the fuel introduced via the injector 22 occurs due to the elevation in temperature of the compressed gas in the cylinder beneath the piston 16 as in a conventional diesel engine. However, it is possible that ignition can be effected by a sparking arrangement as in a four stroke petrol engine. FIG. 7*b* illustrates the state of the engine 50 immediately after ignition of the fuel beneath the piston 16 in the cylinder 14. All of the valves 52, 54, 56, 58 are closed. In FIGS. 7*b* to 7*e*, the impeller arrangements 18 at each end of the cylinder have been omitted for clarity but ignition of the fuel creates rapidly expanding combustion gases which are caused to swirl as described above in relation to FIGS. 1 to 3 and that, in turn, causes the impellers 18 to turn.

The air compressor 64 continues to drive air along outlet path 66, driving first external impeller 68 and pressurising the air in gas inlet flow sub-paths 76*a, b*. The second external impeller 72 is driven by drive shaft 70, which drives air out of the gas outlet flow sub-paths 74*a, b* to reduce the pressures in those areas below ambient pressure.

The combustion of the fuel forces the piston upwardly in the cylinder in FIG. 7*b*. That upward movement compresses the air in the cylinder 14 above the piston 16. The piston 16 continues to move upwardly in the cylinder until the point illustrated in FIG. 7*c*. As the piston passes the position of the valves 54, 58 in the cylinder walls, gas outlet valve 58 is opened, as shown in FIG. 7*d*. The hot exhaust gases beneath the piston 16 in the cylinder are evacuated out of the cylinder as a result of the reduced pressure in the outlet flow sub-path 74*b*. The evacuated gases pass into the gas outlet flow sub-path, elevating the pressure in that path above ambient. Those gases pass over the second external impeller 72, driving it in rotation which turns the drive shaft 70 and, in turn, the first external impeller 68. The drive shaft 70 may additionally drive an electric generator (not shown) and the power generated can provide motive power for example for a vehicle by means of an electric motor.

As the piston 16 moves towards the top of its travel in the cylinder, one of the gas inlet valves 52, 54 is opened and the pressurised air in the respective gas inlet flow sub-path 76*a*, 76*b* passes into the cylinder 14 below the piston 16. This serves to drive the piston 14 to its uppermost position in FIG. 7*e*, further compressing the air above the piston. At the point illustrated in FIG. 7*e*, fuel is injected into the area of the cylinder above the piston. The fuel ignites and the cycle described above repeats as the piston travels downwardly in the cylinder.

In addition to the exhausted combustion gas driving the second external impeller as it is exhausted to atmosphere, the internal impellers are driven in rotation by the swirling combustion gases as described above in relation to FIG. 1. In the arrangement described, the engine can be adapted to different fuel types without any structural changes. The change in compression ratio moving from, e.g. spark ignition petrol to compression ignition diesel, is effected by changing the amount of compression applied by the inlet air passing via the valves 52, 54 in the FIG. 7*a* phase of the engine cycle.

FIGS. 8 to 11 illustrate how the power from each of the internal impellers is transmitted to an output drive shaft of the engine.

In FIGS. 8 & 9, four cylinders 14 of the form described above in FIGS. 1 to 7 are arranged equispaced in a circular configuration (three are show in FIG. 8 as one is obscured). Each cylinder has an internal impeller arrangement at each end with a drive shaft bearing a toothed gear wheel 32. Surrounding each end of the set of four cylinders, respectively, is a large annular gear wheel 78 with teeth on its internal and external peripheries. The cylinder gear wheels 32 mesh with the internal teeth on the annular gear wheel 78. A main output drive shaft 82 carries two output drive shaft gears 80 which each mesh respectively with the external teeth of the annular gear wheels 78. The cylinder gear wheels 32 are driven as described above by the impellers in the cylinders. The cylinder gear wheels drive the annular gear wheels 78. The annular gear wheels 78 drive the output drive shaft gears 80 to drive the drive shaft 82.

In the arrangement of FIG. 10, the cylinders are arranged around the periphery of an externally toothed main gear wheel which is mounted to the output drive shaft 82.

In FIG. 11, an array of four cylinders (two shown) drives a single annular gear 78 of the type shown in FIG. 8. Unlike the gear of FIG. 8, the annular gear wheel 78 in FIG. 11 is mounted on a central shaft which also carries two compressor discs in a jet nozzle to effect compression of incoming air. The compressed air is passed to the air intake of the cylinders in place of the compressor 64 in FIG. 7. Motive power from the engine is also taken off the central shaft by connection to a gearbox (not shown). The FIG. 11 arrangement could be used to provide motive power to drive a turbo propeller for an aircraft.

In FIG. 12, an alternative arrangement of internal combustion engine for use with water/fuel emulsions is shown. Parts corresponding to parts in FIG. 1 carry the same reference numerals.

The engine of FIG. 12 is similar in most respects to that shown in FIG. 1 with some exceptions.

In FIG. 12, the engine block 12 defines a combustion chamber 80. Unlike FIG. 1, in FIG. 12, there is no reciprocating piston.

Instead, the combustion chamber 80 is split into two sub-chambers 82, 84 arranged back to back so that the sub-chambers share one common end 86 and each have a respective opposite end 88, 90 with an impeller arrangement of the type described in FIG. 1.

The common end 86 is defined by a wall 92. On each face 94, 96 of the wall 92 is a swirl-inducing formation 98, 100 similar to the formations 38, 40 on the piston 16 in FIG. 1

A spark plug ignition device 102, 104 extends into the combustion sub-chambers 82, 84 adjacent the swirl-inducing formations 98,100.

As in FIG. 1, fuel is provided to the combustion sub-chambers 82, 84 via fuel injector port 22 except in FIG. 12 a fuel/water emulsion is injected rather than pure fuel.

Also as in FIG. 1, an air inlet port 23 and an exhaust outlet port 25 extend through the block wall.

In use, a water/fuel emulsion is injected via injector 22, air is introduced via air inlet port 23 and the mixture is ignited by the ignition device 102, 104. It is believed that the water/fuel emulsion removes the need for compression as the initial explosion releases the oxygen ions in the water for further combustion.

The hot, expanding combustion gases are caused to swirl by the formations 98, 100 and those swirling gases act on the impellers 18 as in FIG. 1.

The FIG. 12 arrangement is installed in the arrangement of FIG. 7 in place of the cylinder 14 and the gas cycle described in FIG. 7 applies to FIG. 12 with the alteration that there is no reciprocating piston.

The invention claimed is:

1. An internal combustion engine comprising an engine block defining a cylinder having a longitudinal axis, a piston arranged slidably within the cylinder and an impeller arranged at one end of the cylinder, the impeller being rotatably mounted on a shaft, which shaft extends out of the cylinder and which is driven in rotation by rotation of the impeller, the engine further comprising an anti-rotation formation to prevent the piston rotating about a longitudinal axis of the cylinder and a swirl-inducing vane arranged on the face of the piston which faces the end of the cylinder at which the impeller is arranged, whereby combustion gas generated by combustion of a fuel in the cylinder between the piston and the impeller is caused to swirl by reaction with the swirl-inducing vane and the swirling combustion gases, in turn, cause the impeller to rotate.

2. An internal combustion engine according to claim 1, in which the piston includes a plurality of swirl-inducing vanes on the face which faces the end of the cylinder at which the impeller is arranged.

3. An internal combustion engine according to claim 1, in which an impeller is arranged at each end of the cylinder and a piston is provided with a swirl-inducing vane or vanes on opposite faces thereof facing the impellers.

4. An internal combustion engine according to claim 3, in which a fuel-injector is arranged to inject fuel into the cylinder at both ends thereof.

5. An internal combustion engine according to claim 1 in which an ignition mechanism is arranged at or adjacent the end of the cylinder in which the impeller is located.

6. An internal combustion engine according to claim 4, in which ignition mechanisms are provided at both ends of the cylinder.

7. An internal combustion engine according to claim 1, in which fuel is ignited by compression effected by the movement of the piston in the cylinder in similar fashion to a diesel engine.

8. An internal combustion engine comprising an engine block which defines an elongate cylinder having a longitudinal axis, a piston arranged in the cylinder so as to be slidable longitudinally back and forth in the cylinder, the piston not being connected mechanically to an output drive shaft of the engine, whereby combustion of fuel on one side of the piston causes movement of the piston along the cylinder to displace gas in the cylinder on the other side of the piston, so that combustion gases produced by said combustion drive an internal impeller which is connected via an external gear drive shaft to a gear external to the cylinder whereby at least some motive power of the engine is generated by the combustion gases acting on the internal impeller.

9. An internal combustion engine according to claim 8 in which the piston has a swirl-inducing vane on one face thereof and the internal impeller is arranged at the end of the cylinder facing the piston with a vane so that combustion gas generated by combustion of a fuel in the cylinder is caused to swirl by reaction with the swirl-inducing vane and the swirling combustion gases, in turn, cause the internal impeller to rotate.

10. An internal combustion engine according to claim 8, in which the internal impeller drives the external gear drive shaft and the external gear drive shaft is drivingly connected to a main output drive shaft of the engine.

11. An internal combustion engine according to claim 10, in which the external gear drive shaft drives an electrical generator to generate electrical power which can, in turn, be used to provide motive power.

12. An internal combustion engine according to claim 8, in which the external gear shaft drives a main output drive shaft of the engine to power or drive a vehicle or an electrical generator, allowing generation of electricity which, in turn, can be used to provide motive power.

13. An internal combustion engine comprising a plurality of cylinder housings, each defining therewithin an elongate cylinder, each cylinder having a longitudinal axis, each cylinder having a drive shaft which extends out of the cylinder housing, axially of the cylinder, each drive shaft having a toothed gear wheel thereon, the engine further comprising a main gear which drives an output drive shaft, the gear wheels of the drive shafts being arranged to mesh with the main gear whereby rotation of the drive shaft of a cylinder rotates the main gear which, in turn, rotates the output drive shaft, the cylinders being arranged around the periphery of the main gear, wherein each cylinder has an internal impeller arrangement drivingly connected to the respective drive shaft.

14. An internal combustion engine according to claim 1, further comprising a plurality of cylinder housings, each defining therewithin an elongate cylinder, each cylinder having a longitudinal axis, each cylinder having a drive shaft which extends out of the cylinder housing, axially of the cylinder, each drive shaft having a toothed gear wheel thereon, the engine further comprising a main gear which drives an output drive shaft, the gear wheels of the drive shafts being arranged to mesh with the main gear whereby rotation of the drive shaft of a cylinder rotates the main gear which, in turn, rotates the output drive shaft, the cylinders being arranged around the periphery of the main gear, wherein each cylinder has an internal impeller arrangement drivingly connected to the respective drive shaft.

15. An internal combustion engine according to claim 13, in which the main gear comprises an internally toothed ring and the cylinders are arranged around the periphery of the main gear internally of the main gear.

16. An internal combustion engine according to claim 13, in which the main gear has external teeth and the cylinders are arranged around the outer periphery of the main gear.

17. An internal combustion engine according to claim 13, in which the output drive shaft from the main gear drives the input shaft of a vehicle transmission or an electrical generator to effect generation of electrical power, the electrical power being used to provide motive force.

18. A method of operating an internal combustion engine according to claim 1, the engine comprising an engine block, a cylinder formed in the engine block and a piston arranged slidably reciprocal in the cylinder, a gas inlet valve arranged adjacent one end of the cylinder, to allow gas to pass into the cylinder, and a gas outlet valve adjacent said one end of the cylinder to allow gas in the cylinder to pass to a gas outlet path, a gas inlet valve arranged adjacent to the opposite end of the cylinder and a gas outlet valve arranged adjacent the opposite end of the cylinder, the method comprising the steps of;

i) closing the gas outlet valves, ii) introducing gas into the cylinder on one side of the piston via one or both of the gas inlet valves so as to force the piston away from said one end towards said opposite end and to compress gas in said opposite end, iii) maintaining a gas pressure in the gas outlet path at a level below ambient pressure, iv) introducing fuel into the cylinder at said opposite end, v) igniting the introduced fuel so as to cause the piston to move along the cylinder away from said opposite end towards said one end, thereby further compressing gas in the cylinder at said one end, vi) opening the gas outlet valve at said one end to allow combustion gas to pass to the gas outlet path as the piston passes the gas outlet valve at said one end, vii) introducing gas into the cylinder via the gas inlet valve at said opposite end, so as to force the piston away from said opposite end and to compress gas at said one end as the piston moves towards the end of its travel toward the one end, viii) evacuating the combustion gas from the gas outlet path and establishing a gas pressure in the gas outlet path at a level below ambient pressure, ix) introducing fuel into the cylinder at said one end, x) igniting the introduced fuel so as to cause the piston to move along the cylinder away from said one end towards said opposite end, thereby further compressing gas at said opposite end, xi) opening the gas outlet path at said opposite end to allow combustion gas to exhaust from the cylinder to the gas outlet path, xii) repeating steps i) to xi).

19. A water/fuel emulsion fuelled internal combustion engine comprising an engine block defining a combustion chamber, a fuel inlet port leading into the chamber, a combustion gas outlet port leading from the chamber, an impeller in the chamber, the impeller being rotatably mounted on a shaft, which shaft extends out of the combustion chamber and which is driven in rotation by rotation of the impeller, a swirl-inducing formation being formed on an inside wall of the combustion chamber spaced from and generally opposite the impeller, an ignition device arranged adjacent the swirl-inducting formation, and an ignition mechanism adjacent the swirl-inducing formation whereby a water/fuel emulsion and air are introduced into the chamber, the ignition mechanism ignites the emulsion/air mixture and the combustion gases are caused to swirl by the swirl-inducing formation so as to impart rotation to the impeller.

* * * * *